US007299778B2

(12) United States Patent
Kuckuk

(10) Patent No.: US 7,299,778 B2
(45) Date of Patent: Nov. 27, 2007

(54) SWITCHABLE CAM FOLLOWER

(75) Inventor: Andre Kuckuk, Herzogenaurach (DE)

(73) Assignee: Schaeffler KG, Herzogenaurach (DE)

( * ) Notice: Subject to any disclaimer, the term of this patent is extended or adjusted under 35 U.S.C. 154(b) by 66 days.

(21) Appl. No.: 11/416,241

(22) Filed: May 2, 2006

(65) Prior Publication Data

US 2006/0249113 A1 Nov. 9, 2006

(30) Foreign Application Priority Data

May 3, 2005 (DE) ..... 10 2005 020 580

(51) Int. Cl.
*F01L 1/14* (2006.01)

(52) U.S. Cl. ..... 123/90.59; 123/90.48; 123/90.52; 123/90.55; 123/198 F

(58) Field of Classification Search ..... 123/90.59
See application file for complete search history.

(56) References Cited

U.S. PATENT DOCUMENTS

| | | | | |
|---|---|---|---|---|
| 6,578,535 | B2 * | 6/2003 | Spath et al. | 123/90.16 |
| 7,055,479 | B2 * | 6/2006 | Sailer et al. | 123/90.59 |
| 7,210,439 | B2 * | 5/2007 | Geyer et al. | 123/90.55 |

FOREIGN PATENT DOCUMENTS

| | | | |
|---|---|---|---|
| DE | 102 04 672 A 1 | 2/2002 | |
| EP | 0 652 353 A1 | 10/1994 | |

* cited by examiner

*Primary Examiner*—Thomas Denion
*Assistant Examiner*—Kyle M. Riddle
(74) *Attorney, Agent, or Firm*—Charles A. Muserlian

(57) ABSTRACT

The invention proposes a switchable cam follower (1) for a valve train of an internal combustion engine, said cam follower comprising two elements (2, 3) telescoped into each other and, axially displaceable relative to each other. A bore (4) comprising at least one piston (5) extends in the inner element (2). The piston (5) has, on a portion of its outer peripheral surface (7), a stepped entraining surface (8) that starts from the first front end (6) of the piston (5) facing the outer element (3). For achieving coupling, the piston (5) can be displaced with this entraining surface (8) onto a flat counter surface (10) of the other element (3). The entraining surface (8) of the piston (5) extends, starting from the first front end (6), toward a second front end (11) of the piston (5) while tapering into a conical shape generally in the direction toward a longitudinal axis of the piston (5). Besides this, an edge region (12) of the entraining surface (8) on the first front end (6) is additionally provided with a cylindrical, outwards arched (with reference to a starting point of the radius (R)) contour (13) that extends orthogonally to the longitudinal axis of the piston (5). In this way, during the coupled state of the piston (5) and its inevitable tilting, the edge abrasion feared in the prior art does not occur any longer. The manufacturing tolerances in the region of coupling can be coarsened, i.e. slackened.

7 Claims, 2 Drawing Sheets

SWITCHABLE CAM FOLLOWER

FIELD OF THE INVENTION

The invention concerns a switchable cam follower or a switchable support device for a valve train of an internal combustion engine, said cam follower or support element comprising two elements telescoped into each other and axially displaceable relative to each other, one of the two elements comprising a bore extending perpendicular to a longitudinal axis toward the other of the two elements and at least one piston being arranged in the bore to extend within the bore in an uncoupled state of the elements, said piston comprising on a portion of an outer peripheral surface, a stepped entraining surface that starts from a first front end of the piston facing the other element, and coupling being achieved by a displacement of the piston partially beyond a parting plane between the elements so that the entraining surface comes to bear against a flat counter surface of the other element.

BACKGROUND OF THE INVENTION

A cam follower of the pre-cited type, configured here as a roller tappet, is disclosed in DE 102 10 747 A1 that is considered generic. The lash of the two pistons in their receptions that is required for coupling causes them to tilt in the receptions. This occurs during every cam lift and causes an underside of the pistons to abut against a corresponding counter surface of the annular reception of the outer element. Due to the tilting of the pistons, a contact zone is shifted from the inside of the counter surface of the annular groove (radially outside) to an edge section of this at the parting plane between the elements (radially inside). Thus, in this case, only a two-point contact exists.

This two-point contact in the edge section leads to an extreme rise of the contact forces. If, at the same time, shape, rectangularity and parallelism variations exist, the aforesaid effect is intensified. Due to the high loads precisely in the edge region, an undesired increase of lash in the coupling region takes place over the service life of the cam follower. The edge region gets deformed. In the worst case, this can lead to a jamming of the two elements or to a failure of the coupling function.

OBJECTS OF THE INVENTION

It is therefore an object of the invention, to provide a cam follower of the pre-cited type in which the cited drawbacks are eliminated.

This and other objects and advantages of the invention will become obvious from the following detailed description.

SUMMARY OF THE INVENTION

The invention achieves the above objects by the fact that, starting from the first front end of the piston, the entraining surface of the piston extends toward a second front end of the piston while tapering into a conical shape generally in a direction toward a longitudinal axis of the piston, and an edge region of the entraining surface on the first front end and at least a part of a length of the entraining surface is additionally provided with a cylindrical, outwards arched (with reference to a starting point of the radius (R)) contour that extends orthogonally to the longitudinal axis of the piston.

Through the aforesaid measures, the initially described drawbacks are effectively avoided. During the inevitable tilting of the pistons in the coupled state, the contact zone is now very reliably shifted from the endangered radially inner edge section to the radially outer counter surface that is preferably a part of an annular groove.

The thus quasi backwards facing conical or wedge-like configuration of the entraining surface, in combination with the configuration of a radius on this surface, is relatively simple to realize from the fabrication point of view. Machining as well as shaping methods without chip removal are equally well suited.

Due to the proposed geometry of at least one of the pistons used for coupling and in conjunction with the geometry of the preferably flat counter surface, the introduced forces can be excellently supported in the coupled state, and this, at the same time, with low wear. The permissible contact pressure in the coupling region is not exceeded.

In addition, the measures proposed by the invention have the advantage that the manufacturing tolerances for a geometry of the entraining surface of the piston can be coarsened, i.e. slackened. Because, in this way, an exact monitoring of the variation of the angle of the entraining surface during fabrication and assembly is thus no longer necessary, the costs of manufacture can be reduced.

The aforesaid angle of the entraining surface is situated preferably in a range of $5' < \alpha \leqq 5°$. However, it is also conceivable to set a lowest range at $\alpha = 0°$.

The scope of protection of the invention extends to all kinds of switchable cam followers or switchable support devices. It is also conceivable to use the invention in cam follower groups and in switchable lever systems. Explicitly, the scope of this invention concerns, for example, switchable roller tappets, switchable mushroom-type tappets, switchable cup tappets and switchable support elements. These can optionally be provided with a hydraulic or a mechanical lash adjustment.

In place of the cylindrical contour of the entraining surface that extends in transverse direction of the piston concerned, a convex geometry of the pistons is also within the scope of the invention.

According to a further feature of the invention, only that portion of the entraining surface of the piston that is predominantly in contact with the counter surface during the coupled-state, has the cylindrical contour. This can have a favorable effect on the manufacturing costs.

It is further proposed to flatten at least the first front end of the piston into a convex shape. One advantage of this is that when the piston has come to abut against the bottom of the annular groove, it can be easily displaced again hydraulically in the opposite direction.

According to a further proposition of the invention, the counter surface on the other element, for example, on an outer circular cylindrical element, is an annular surface that is a part of a continuous annular groove. As a result, anti-rotation measures for the elements relative to each other can be dispensed with. At the same time, a good linear contact that reduces surface loading, exists in the coupled state. In place of the annular surface, it is, however, also conceivable to provide only segmental annular surfaces, or further, to provide a bore into which the respective piston penetrates in the coupled state.

The invention will now be described more closely with reference to the appended drawings.

DETAILED DESCRIPTION OF THE DRAWINGS

Figure 1:
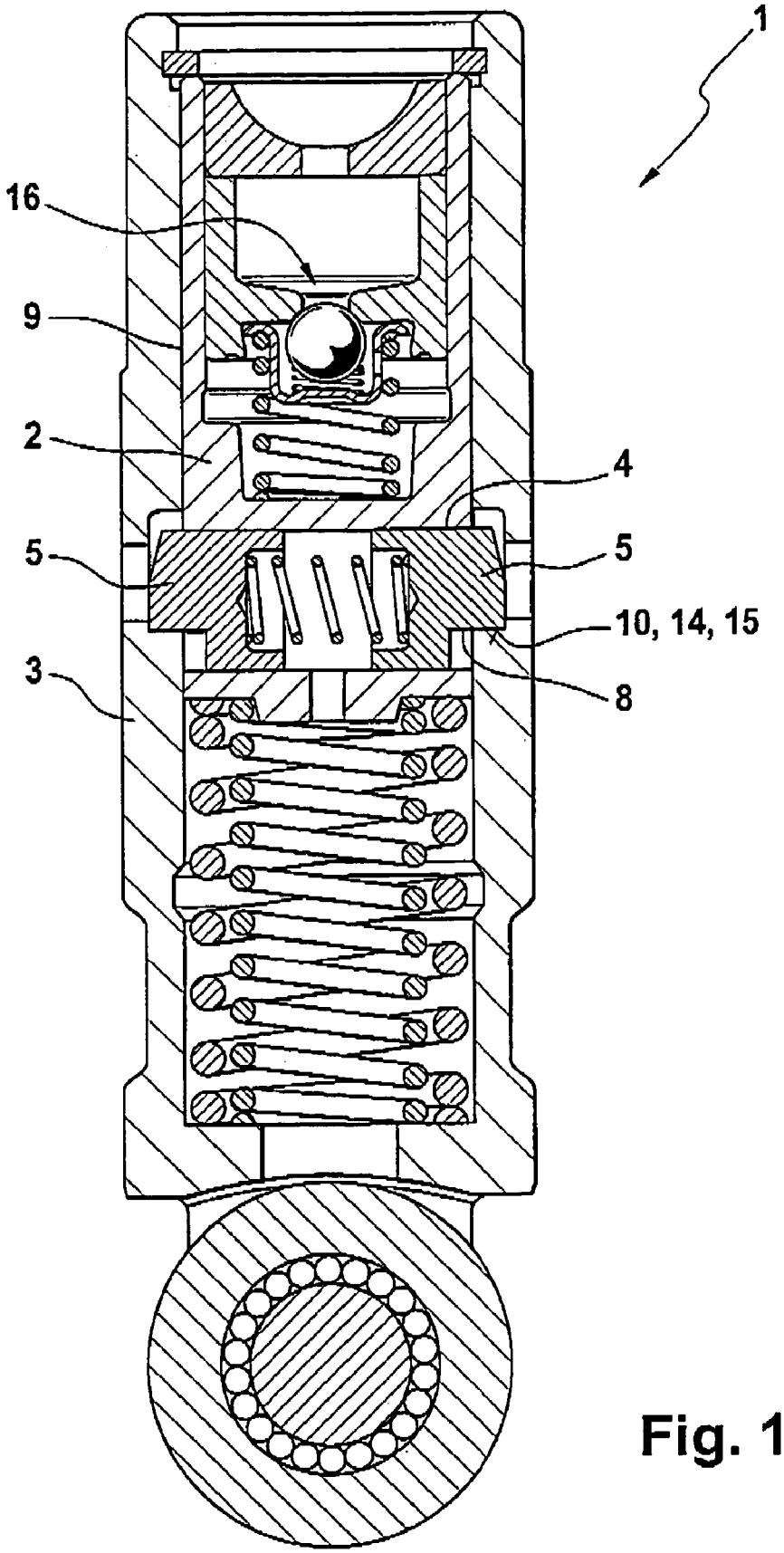
FIG. 1 shows a switchable cam follower in longitudinal section.

FIG. 1 discloses a longitudinal section through a cam follower 1. In the present case, the cam follower is configured as a roller tappet and comprises an outer, hollow cylindrical element 3 that is telescoped with an inner element 2 for axial displacement relative to each other. Radially through the inner element 2 extends a bore 4 comprising two pistons 5 that are situated diametrically opposite each other in the uncoupled state. The inner element 2 further comprises a hydraulic lash adjusting device 16, that needs no closer specification here.

The invention will be described in more detail with reference to FIGS. 2 and 3. It can be seen that each piston 5, starting from its first front end 6 that faces the radially outer element 3, has, on a part of its outer peripheral surface 7 (here, underside), a stepped entraining surface 8. This has, so to speak, a "reversed conical" configuration and extends from the first front end 6 of the piston 5 to its second front end 11, while generally tapering like a cone toward the longitudinal axis of the piston 5.

Figure 2:
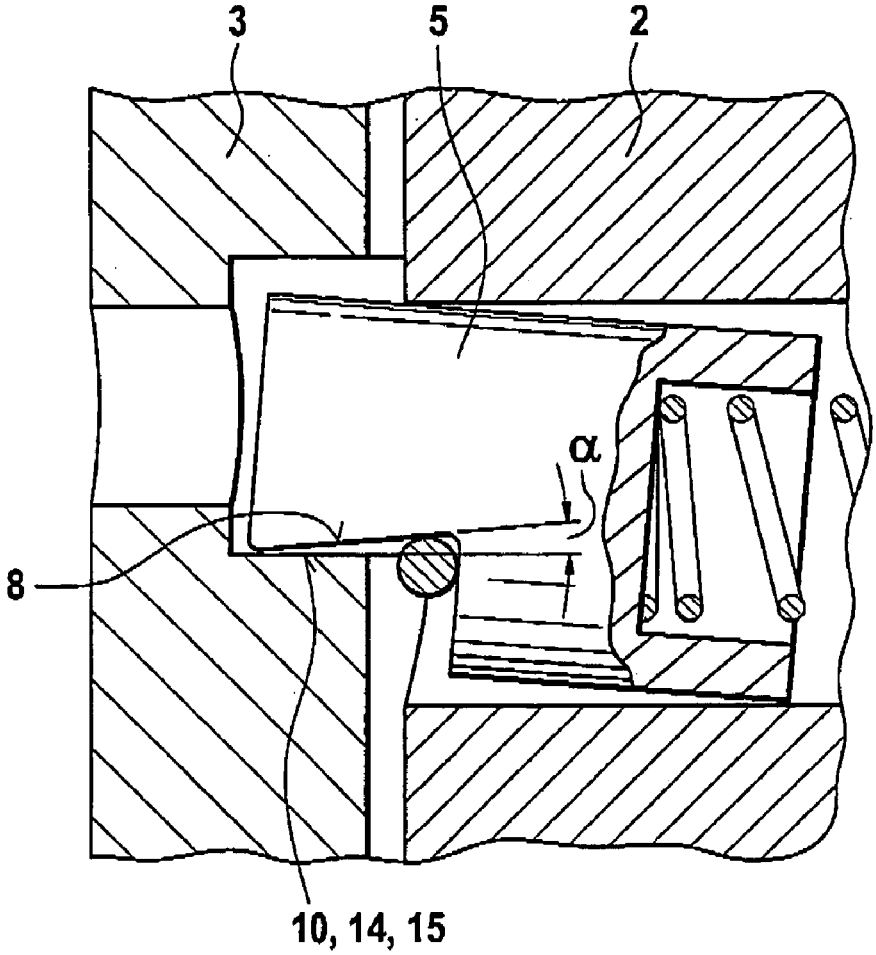
FIG. 2 shows a coupling mechanism with a stepped and conically tapering piston in a coupled state, without a cylindrical convexity.
Figure 3:
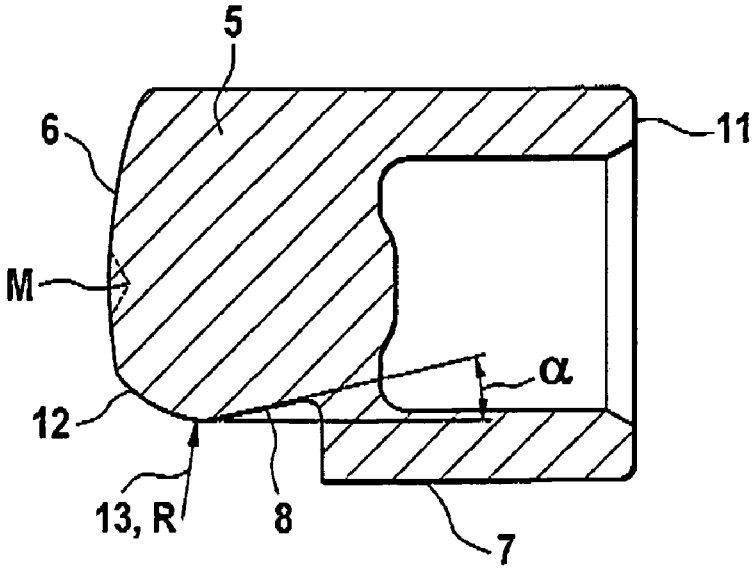
FIG. 3 shows a detail representation of the piston of the invention.

The angle $\alpha$ of inclination of the entraining surface 8, roughly indicated in FIGS. 2 and 3, is preferably intended to be situated in a range of $5<\alpha\leqq 5°$. The piston 5 in FIG. 2 is disclosed (see also FIG. 1) in its retracted position in an annular groove 15 of the outer element 3. This is a coupled state of the elements 2 and 3 for a high valve lift. In addition, as shown more closely in FIG. 3, the entraining surface 8 possesses in its edge region 12 on the first front end 6 as also at least on an adjoining portion of its length, a cylindrical, outwards arched contour 13 that extends orthogonally to the longitudinal axis of the piston 5. This rounded contour 13 can be created, for instance, during a final phase of manufacture of the respective piston 5 by a grinding or similar method.

To sum up, it can be said that when the coupling means 5 engages the annular groove 15 of the outer element 3 for coupling, a contact region that is formed due to tilting of the coupling means 5 and is otherwise situated on an edge of the annular groove 15 to the parting plane 9, is now situated radially outside of this edge (within the annular groove 15) on the counter surface 10 configured as an annular surface 14. Wear in the edge region, as discussed more closely above, is avoided. At the same time, the surface pressure existing during coupling is relatively low and easy to control. Further, the manufacturing tolerances, particularly those for the geometry of the entraining surface 8 of the piston 5 concerned can be coarsened. FIG. 2 shows precisely the state of tilting of the piston 5 under load. In addition, it can be seen from FIG. 3 that the radially outer, first front end 6 of the piston 5 has a convex shape starting from its center M.

The invention claimed is:

1. A switchable cam follower or a switchable support device for a valve train of an internal combustion engine, said cam follower or support element comprising two elements telescoped into each other and axially displaceable relative to each other, one of the two elements comprising a bore extending perpendicular to a longitudinal axis toward the other of the two elements and at least one piston being arranged in the bore to extend within the bore in an uncoupled state of the elements, said piston comprising on a portion of an outer peripheral surface, a stepped entraining surface that starts from a first front end of the piston facing the other element, and coupling being achieved by a displacement of the piston partially beyond a parting plane between the elements so that the entraining surface comes to bear against a flat counter surface of the other element, characterized in that, starting from the first front end of the piston, the entraining surface of the piston extends toward a second front end of the piston while tapering into a conical shape generally in a direction toward a longitudinal axis of the piston, and an edge region of the entraining surface on the first front end and at least a part of a length of the entraining surface is additionally provided with a cylindrical, outwards arched (with reference to a starting point of the radius (R)) contour that extends orthogonally to the longitudinal axis of the piston.

2. A cam follower or support device of claim 1, characterized in that only that portion of the entraining surface of the piston that, statistically or empirically seen, is most frequently in contact with the counter surface in a coupled state, comprises the cylindrical contour.

3. A cam follower or support device of claim 1, characterized in that at least the first front end of the piston is flattened into a convex shape starting from a center (M) of said first front end.

4. A cam follower or support device of one of the preceding claims, characterized in that the counter surface of the other element is an annular surface that forms a part of a continuous annular groove.

5. A cam follower or support device of claim 1, characterized in that the entraining surface of the piston extends at an angle ($\alpha$), situated in a range of $5'<\alpha\leqq 5°$, relative to a longitudinal axis of the piston.

6. A cam follower of claim 1, characterized in that the cam follower is a roller or mushroom-type tappet acting at least indirectly on a rocker arm, two pistons situated diametrically opposite each other are arranged in a through-bore of the inner element, which pistons, for achieving coupling, can be displaced with an entraining surface onto a counter surface of the outer element, which counter surface is an annular surface and forms a part of a continuous annular groove.

7. A cam follower or support device of one of the preceding claims, characterized in that the cam follower or the support device comprises a hydraulic lash adjusting device.

* * * * *